United States Patent [19]

Djuric

[11] 4,070,741

[45] Jan. 31, 1978

[54] METHOD OF MAKING AN ELECTRET ACOUSTIC TRANSDUCER

[75] Inventor: Svetislav V. Djuric, Stow, Mass.

[73] Assignee: Genrad Inc., West Concord, Mass.

[21] Appl. No.: 788,317

[22] Filed: Apr. 18, 1977

Related U.S. Application Data

[63] Continuation of Ser. No. 726,598, Sept. 27, 1976, abandoned.

[51] Int. Cl.[2] ..... H04R 31/00

[52] U.S. Cl. ..... 29/25.42; 29/592 E; 29/594; 179/111 E

[58] Field of Search ..... 29/594, 592 E, 25.42, 29/25.41; 179/111 E, 111 R

[56] References Cited

U.S. PATENT DOCUMENTS

| | | | |
|---|---|---|---|
| Re. 28,420 | 5/1975 | Murphy | 179/111 E |
| 1,975,801 | 10/1934 | Rieber | 179/111 R |
| 3,663,768 | 5/1972 | Madsen | 179/111 E |
| 3,812,575 | 5/1974 | Hedman | 29/594 |
| 3,895,194 | 7/1975 | Fraim | 179/111 E X |

*Primary Examiner*—Carl E. Hall

*Attorney, Agent, or Firm*—Kenway & Jenney

[57] ABSTRACT

In the method of construction disclosed herein, posts for supporting the condenser transducer diaphragm in relation to a backplate are formed on the diaphragm film itself by selectively etching away a photoresist material laminated to the film. The electret material is then supported on the backplate rather than being carried by the diaphragm.

7 Claims, 7 Drawing Figures

METHOD OF MAKING AN ELECTRET ACOUSTIC TRANSDUCER

This is a continuation of application Ser. No. 726,598 filed Sept. 27, 1976, now abandoned.

BACKGROUND OF THE INVENTION

This invention relates to electret condenser acoustic transducers and more particularly to a method of providing supporting posts for spacing the diaphragm in a transducer with respect to a backplate which constitutes a fixed electrode.

In the manufacture of electret condenser transducers, e.g. microphones, various methods have been proposed for precisely maintaining the desired small separation between the diaphragm which constitutes a moving electrode and a backplate which constitutes a fixed electrode. In addition to various schemes for clamping the diaphragm at its edges, methods have been proposed for forming regular or irregular patterns of ribs, bumps or posts which separate the two elements and effectively divide the diaphragm area into a plurality of regions. Several such methods are disclosed, for example, in the P. V. Murphy reissue Pat. Re. 28,420. As the usual diaphragm material comprises a thin film which is under tension, the straightforward and therefore apparently universally employed method of generating the post pattern is to form it on the backplate while the diaphragm is made comprising the material which can be polarized as an electret.

In accordance with the present invention, however, it has been found that substantial unexpected advantages can be obtained if the post pattern is formed on the diaphragm, despite its thin film nature. A principal advantage is that the backplate, i.e. fixed electrode, may then be formed with a smooth, flat surface and the electret material can then be laid down on that surface. While most of the usual electret materials are plastics or resins, they do not have mechanical properties which are themselves ideal for use as a diaphragm. For example, Teflon, (polytetrafluoroethylene) one of the most stable and commonly used electrets, is not particularly tough or elastic so as to render it ideal for a highly compliant acoustically responsive diaphragm such as is desired in constructing a measurement grade condenser microphone.

In accordance with another aspect of the invention, it has been found that supporting posts appropriate for defining the spacing between the diaphragm and backplate in an electret transducer may be expeditiously formed on a plastic film suitable for use as a diaphragm by conventional photo-etching techniques.

SUMMARY OF THE INVENTION

Briefly, the making of an electret acoustic transducer in accordance with the present invention involves laminating a plastic film with a photoresist material, exposing the photoresist material in a pattern corresponding to the desired post pattern, and then removing, e.g. by etching, the undesired portion of the material leaving the desired post pattern on the film. After metalizing the post side of the film, it is mounted on a supporting ring and the ring and a conductive backplate carrying a layer of polarized electret material are mounted in juxtaposition in a transducer assembly with the post pattern contacting the electret layer. Accordingly, the diaphragmatic film is spaced from the backplate by the post pattern. The metalization on the film provides a moving electrode while the backplate constitutes the fixed electrode. The electret material, being itself insulating, prevents shorting between the electrodes.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
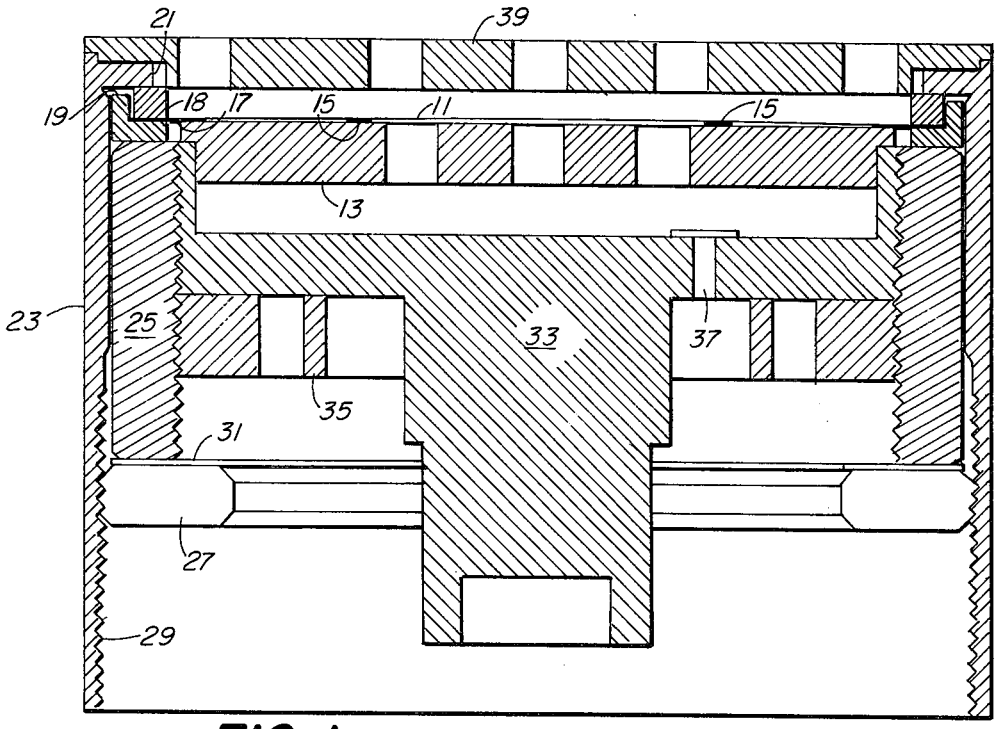
FIG. 1 is a side view, with parts broken away, of a complete electret condenser microphone constructed in accordance with the present invention.

Referring now to FIG. 1, the completed microphone illustrated there by way of an exemplary transducer employs a thin, low mass diaphragm 11 which is supported in close proximity to a backplate 13. As is explained in greater detail hereinafter, the film of diaphragm 11 is metalized to render it conductive and this diaphragm acts as a moving element varying the capacitance of the transducer system. The backplate 13 is likewise conductive and functions as a fixed electrode in the system.

Spacing between the diaphragm 11 and the backplate 13 is controlled to great extent by a series of separators 15 of predetermined thickness. The separators 15 are conventionally designated as posts in spite of their rather shallow height.

Diaphragm 11 is held at its periphery, together with a thin insulating washer 17, between inner and outer supporting rings 18 and 19, respectively. The rings 18 and 19 together with the diaphragm 11 and washer 17 are preferably bonded together, e.g. by an epoxy adhesive. The rings 18 and 19 are clamped against the upper rim 21 of an otherwise generally cylindrical housing 23 by an insulating sleeve 25 which is in turn urged upwardly by a lock nut 27 which engages internal threads 29 on the lower part of the housing 23. A fiber washer 31 may be interposed between the lock nut 27 and the sleeve 25.

The sleeve 25 is internally threaded and carries, in these threads, a backplate terminal assembly 33 which carries the backplate 13. Accordingly, the height of the backplate with respect to the mounting rings 19 and 21 and the diaphragm 11 carried thereby may be adjusted by appropriately rotating the assembly 33 with respect to the sleeve 25. The assembly 33 may be maintained at the desired level by tightening an inner locknut 35 against the assembly.

The backplate carrier 33 is vented as indicated at 37 to allow pressures on the back side of the diaphragm 11 to equalize. The microphone capsule is completed by a perforated cover 39, the shape and the orientation of the perforations in the cover being selected in relation to the desired acoustic characteristics desired of the microphone.

Figure 5:
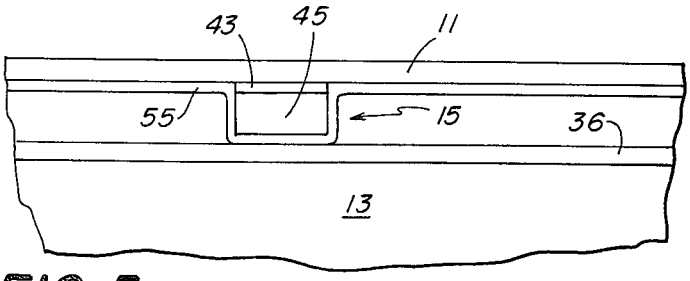
FIG. 5 illustrates, to enlarged scale, portions of the completed diaphragm and backplate employed in the microphone of FIG. 1.

As indicated previously, the formation of the separating posts 15 on the diaphragm allows the electret material to be laid down on the essentially flat top surface of the backing plate 13. This layer is indicated at 36 in FIG. 5 which diagrammatically illustrates, to enlarged scale, the diaphragm 11 and backplate 13 in juxtaposition. The presently preferred material for the electret layer 36 is polytetrafluoroethylene (Teflon). This material may be polarized with a high degree of stability as taught in U.S. Pat. No. 3,644,605, the Sessler et al patent.

Figure 2:
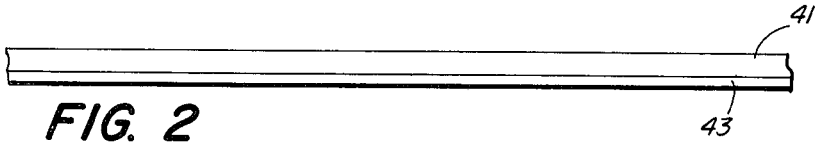
FIG. 2 illustrates a metalized plastic film employed as a diaphragm material in accordance with the method of the present invention.
Figure 3:
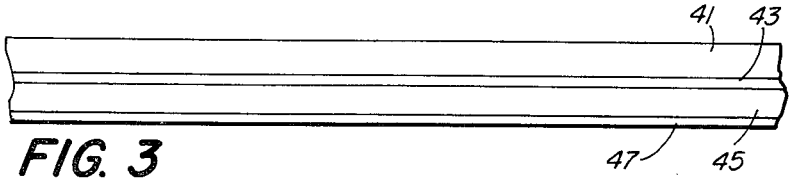
FIG. 3 illustrates the film of FIG. 2 laminated with a photoresist material.
Figure 6:
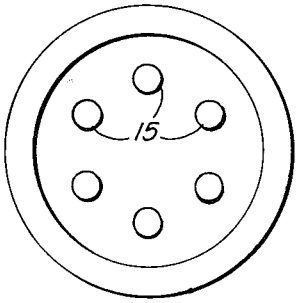
FIG. 6 illustrates a post pattern useful with a microphone of a nominal one inch diameter.
Figure 4:
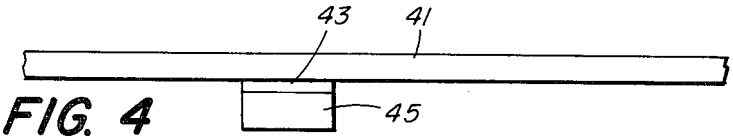
FIG. 4 illustrates the laminate of FIG. 3 following exposure and etching to leave a desired pattern on the film.
Figure 7:
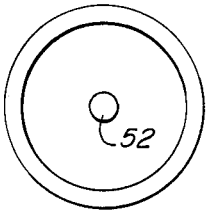
FIG. 7 illustrates a post pattern useful with a microphone of a nominal half inch diameter.

In order to ultimately obtain the desired acoustic properties, the diaphragm 11 preferably comprises a relatively tough and elastic plastic film such as that sold under the tradename Mylar. A thickness of about one quarter mil is appropriate for the film itself. In constructing the diaphragm with its spacing posts in accordance with the present invention, the film is laminated with a conventional photoresist material. A presently preferred photoresist material of this type is that available commercially under the designation Dynachem type AX resist film. Adhesion of this material with the Mylar film is improved if the Mylar is initially metalized. Such metalized film is available commercially from a variety of sources. The metalized film is illustrated diagrammatically in FIG. 2, the Mylar itself being designated by reference character 41, its metalization by reference character 43. It should be understood that the thicknesses of the various layers are not shown to scale but have been exaggerated for the purpose of illustration. In FIG. 3, the laminated structure is illustrated, the photoresist material being indicated at 45 while the adhesive layer is indicated at 47. The photoresist material is supplied with a mylar protective overlay which is indicated at 47 in FIG. 3. This overlay is, however, removed before the resist material is developed. The composite material is exposed and etched using conventional printed circuit techniques to remove all of the photoresist material from the film except those portions constituting the desired post pattern. In the case of a one inch diameter standard microphone, a circular array of posts 15 may be appropriate, as illustrated in FIG. 6, whereas in the case of a half inch diameter standard microphone, a single post 52 in the center of the diaphragm may be appropriate, as illustrated in FIG. 7.

After etching, the underside of the diaphragm is metalized, e.g. by evaporating gold under vacuum onto the surface of the plastic diaphragm to provide a coating which is essentially conducting within the context of the charge movement experienced within a condenser microphone. While metalization in this fashion will typically cover the underside of the posts 15 as well as the intervening surfaces of the Mylar film, e.g. as indicated at 55 in FIG. 5, it should be understood that this conductive coating will not short the transducer capacitance owing to the non-conducting Teflon layer 36 on the top surface of the backing plate against which posts 15 ultimately rest.

In assembling the microphone, the height of the backing plate is adjusted with respect to the diaphragm mounting rings so that the posts lift the diaphragm slightly, i.e. distorting it slightly, and thereby themselves establish the nominal spacing between the two plates of the capacitor.

With the layer 36 polarized, a charge distribution within the transducer exists such that movement of the diaphragm 11 will cause a voltage to be generated between the metalization on the diaphragm and the metal backing plate 13. The diaphragm is connected through the rings 18 and 19 to the housing 23 which constitutes one output terminal while the backing plate 13 is connected directly to the carrier 33 which comprises the other, i.e. center, output terminal, a conventional arrangement with regard to standard microphones. Thus, a signal generated by vibration of the diaphragm can be conducted out of the transducer to a suitable high input impedance pre-amplifier. In the same fashion, if an alternating electrical voltage is applied between the center terminal 33 and the housing 23, an electrostatic force will be produced between the metalization on the diaphragm and the backplate 13. This force will cause the diaphragm to move thus producing an acoustic output.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. The method of making an electret acoustic transducer comprising:

laminating an elastic diaphragmatic plastic film with a layer of material of predetermined thickness; selectively removing undesired portions of said layer of material, leaving a desired post pattern on the film; metalizing the post side of said film to render it conductive; securing said film to a supporting ring;

providing a conductive backplate carrying on one face thereof a layer of polarized electret material which is itself insulating;

mounting said backplate and said ring in juxtaposition in a transducer assembly with said post pattern contacting the electret layer, the diaphragmatic film being deformed and spaced from the backplate thereby.

2. The method of making an electret acoustic transducer comprising:

laminating an elastic diaphragmatic plastic film with a photoresist material;

exposing said material in a pattern corresponding to a desired post pattern for supporting a diaphragm in the transducer;

removing the undesired portion of said material, leaving the desired post pattern on the film;

metalizing the post side of said film to render it conductive;

securing said film to a supporting ring;

providing a conductive backplate carrying on one face thereof a layer of polarized electret material which is itself insulating;

mounting said backplate and said ring in juxtaposition in a transducer assembly with said post pattern contacting the electret layer, the diaphragmatic film being deformed and spaced from the backplate thereby.

3. The method as set forh in claim 2 wherein said supporting post pattern comprises a circular post in the center of said ring.

4. The method as set forth in claim 2 wherein said supporting post pattern comprises a circular array of posts concentric with said ring.

5. The method as set forth in claim 2 wherein said photoresist material comprises a copper foil and a photosensitive resist material and wherein the undesired portions of the copper are removed by etching.

6. The method as set forth in claim 2 wherein said electret material is polytetrafluoroethylene.

7. The method of making an electret acoustic transducer comprising:

vacuum depositing a thin copper layer over a plastic film and laminating it with a photosensitive polymer resist;

exposing said resist in a pattern corresponding to a desired post pattern for supporting a diaphragm in the transducer;

removing the undesired portion of said resist, leaving resist in the desired post pattern on the film;

metalizing the post side of said film to render it conductive;

securing said film to a supporting ring;

providing a conductive backplate carrying on one face thereof a layer of polarized Teflon electret material;

mounting said backplate and said ring in juxtaposition in a transducer assembly with said post pattern contacting the electret layer, the diaphragmatic film being spaced from the backplate thereby.

* * * * *